US005592443A

United States Patent [19]

Kasaya et al.

[11] Patent Number: 5,592,443

[45] Date of Patent: Jan. 7, 1997

[54] STRUCTURE OF A WATCH AND ASSEMBLING METHOD THEREOF

[75] Inventors: Masahiro Kasaya; Yasuo Kitajima; Takayuki Hasumi, all of Tanashi, Japan

[73] Assignee: Citizen Watch Co., Ltd., Tokyo, Japan

[21] Appl. No.: 350,079

[22] Filed: Nov. 29, 1994

[30] Foreign Application Priority Data

| | | | |
|---|---|---|---|
| Nov. 30, 1993 | [JP] | Japan | 5-064002 U |
| Dec. 22, 1993 | [JP] | Japan | 5-325200 |
| Jun. 21, 1994 | [JP] | Japan | 6-138742 |

[51] Int. Cl.[6] ..... G04C 3/00

[52] U.S. Cl. ..... 368/281; 368/223; 368/228; 368/232

[58] Field of Search ..... 368/281, 282, 368/294–296, 276, 223, 232, 228

[56] References Cited

U.S. PATENT DOCUMENTS

| | | | |
|---|---|---|---|
| D. 220,051 | 3/1971 | Gsell | 368/282 |
| D. 224,550 | 8/1972 | Fainsilber et al. | 368/228 |
| 1,786,762 | 12/1930 | Lyons | 368/282 |
| 4,194,356 | 3/1980 | Mazzilli | 368/11 |
| 4,580,907 | 4/1986 | Cognard . | |
| 4,692,033 | 9/1987 | Mock et al. . | |
| 4,853,910 | 8/1989 | Mock | 368/300 |
| 5,173,884 | 12/1992 | O'Connel | 368/282 |
| 5,396,474 | 3/1995 | Lin | 368/228 |

FOREIGN PATENT DOCUMENTS

| | | | |
|---|---|---|---|
| 0394215 | 10/1990 | European Pat. Off. | 368/228 |
| 2260588 | 6/1973 | Germany | 368/204 |
| 0208685 | 12/1983 | Japan | 368/280 |
| WO94/02888 | 2/1994 | WIPO . | |

*Primary Examiner*—Bernard Roskoski

*Attorney, Agent, or Firm*—Dennison, Meserole, Pollack & Scheiner

[57] ABSTRACT

A watch has a watch case, a module mounted in the watch case, a dial secured to the watch case, and a shield for shielding the dial. The dial has an extending portion outwardly extending from the dial. The dial is secured to the watch case, and the shield is secured to the dial.

14 Claims, 15 Drawing Sheets

STRUCTURE OF A WATCH AND ASSEMBLING METHOD THEREOF

BACKGROUND OF THE INVENTION

The present invention relates to a structure of a watch including a watch case, a dial and a shield glass and a method for assembling those members.

Recently, a wrist watch with a plurality of functions and sensors becomes popular. Furthermore, various types of amusing watches are made. For example, a picture of a mascot of the Japan Professional Football League (J-League) is printed on a dial of a wrist watch. In order to enhance the amusement of the amusing watch, the watch case itself is shaped to match the picture on the dial.

FIG. 16 shows a conventional amusing watch. The watch has a cylindrical watch case 1 made of plastic and having a radially extending outer flange portion 1*a*, an upper recess 1*b*, and a band connecting portion 1*d*. A dial 2 is mounted in the watch case 1 at a lower portion of the recess 1*b*. A module 3 is mounted in the watch case 1 and an inner frame 1 is provided for supporting the module 3 in the watch case. A back 5 is secured to the watch case 1 interposing a packing 1*c*. A shield 6 is mounted on the upper recess 1*b* of the watch case 1. A crown 7 is operatively connected to the module 3. An hour hand 10, minute hand 11 and second hand 12 are secured to hand shafts 13 operatively connected to the module 3.

In the watch, the dial 2 has an amusing picture printed thereon and the outer flange portion 1*a* of the watch case 1 has a picture printed thereon, or a certain peripheral shape projected from the circumference of the shield 6, corresponding to the picture of the dial.

In order to assemble the watch, the dial 2 is secured to the watch case 1. The module 3 is mounted in the watch case 1 and supported by the inner frame 4. The back 5 is secured to the watch case 1 interposing the packing 1*c*. Then, the watch case is inverted, and the hands 10, 11 and 12 are securely mounted on the respective shafts 13. The shield 6 is secured to the upper recess 1*b* of the watch case 1.

In such a watch, the contour of the outer flange portion 1*a* is shaped for enhancing the amusing feeling relative to the picture on the dial 2. Therefore, it is necessary to provide various types of molding dies for the watch case 1 for increasing design variations. As a result, the manufacturing cost for a molding die increases.

Since the outer flange portion 1*a* of the watch case 1 and the dial 2 are separated from each other, it is difficult to print a continuous picture on the dial and the flange portion.

In addition, the crown 7 is projected from the underside of the outer flange portion 1*a*, so that the appearance of the watch is deteriorated. Furthermore, it is necessary to form a groove in the watch case 1 for receiving the packing 1*c* which causes the structure of the watch to further complicate and the number of parts to increase.

FIG. 17 shows another conventional watch. The watch comprises a watch case 8 made of plastic and having outer flange portion 8*a*, an upper recesses 8*b* and 8*c*, and an inner recess 8*e* for the module 3. A dial 9 is mounted on the upper recess 8*c* of the watch case 8 and a shield 14 is mounted on the recess 8*b* of the watch case and the periphery of the dial 9. Other structures are the same as the watch of FIG. 16.

In order to assemble the watch, the module 3 is mounted in the recess 8*e* of the watch case 8, the dial 9 is secured to the upper recess 8*c*, hands 10, 11 and 12 are secured to the shafts 13, and the shield 14 is securely mounted on the recess 8*b*.

In the watch, since the back is integrally formed with the watch case 8 as a bottom plate thereof, the back 5 and the packing 1*c* of FIG. 16 are omitted, thereby reducing the number of parts. However, other disadvantages of the watch of FIG. 16 are sill remained.

SUMMARY OF THE INVENTION

An object of the present invention is to provide an external structure of an amusing watch which may reduce manufacturing cost for molding dies for a watch case and the number of parts, thereby increasing quality of appearance of the watch.

According to the present invention, there is provided a structure of a watch having a watch case, a module mounted in the watch case, a dial secured to the watch case, hands disposed above the dial and operatively connected to the module, and a shield for shielding the dial.

The structure comprises an extending portion outwardly extending from the dial. The dial is secured to the watch case, and the shield is secured to the dial.

These and other objects and features of the present invention will become more apparent from the following detailed description with reference to the accompanying drawings.

DETAILED DESCRIPTION OF THE PREFERRED EMBODIMENTS

Figure 1:
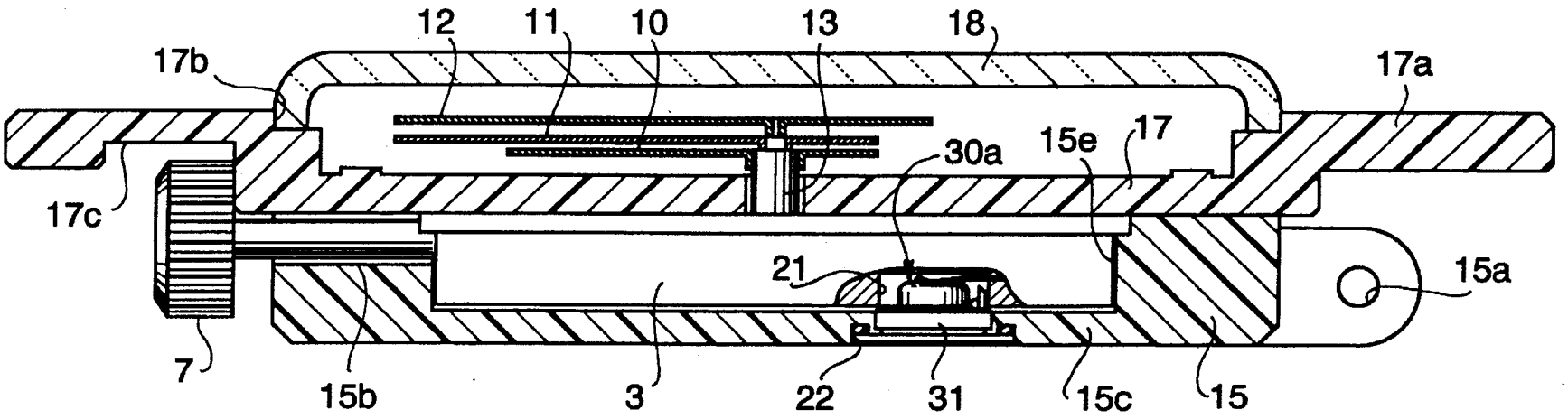
FIG. 1 is a sectional view showing a watch of the present invention.
Figure 16:
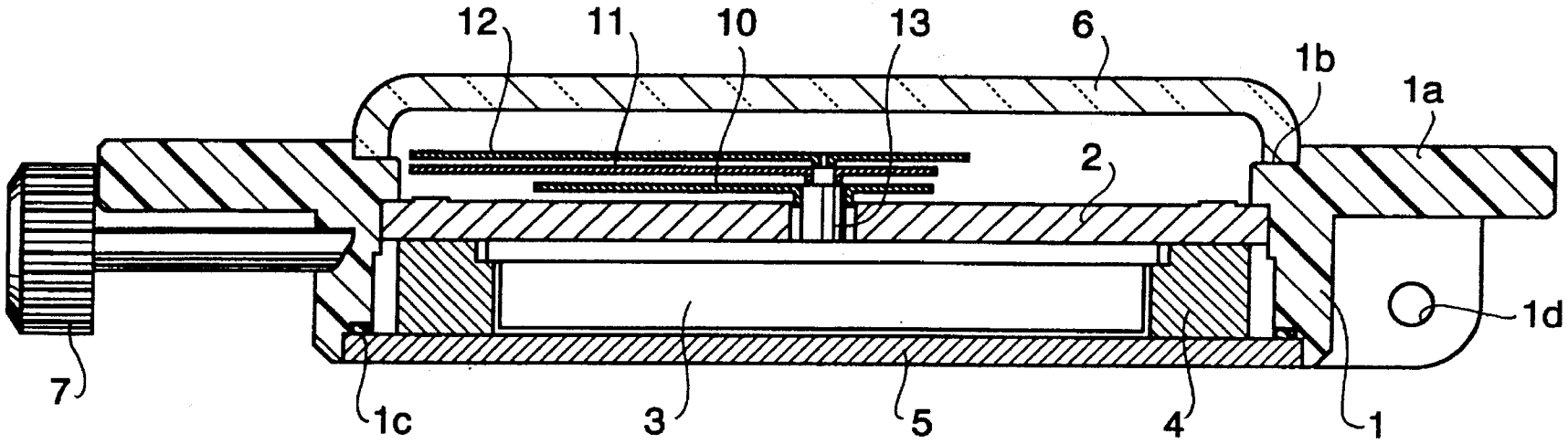
FIG. 16 PRIOR ART
FIG. 16 is a sectional view showing a conventional watch.
Figure 17:
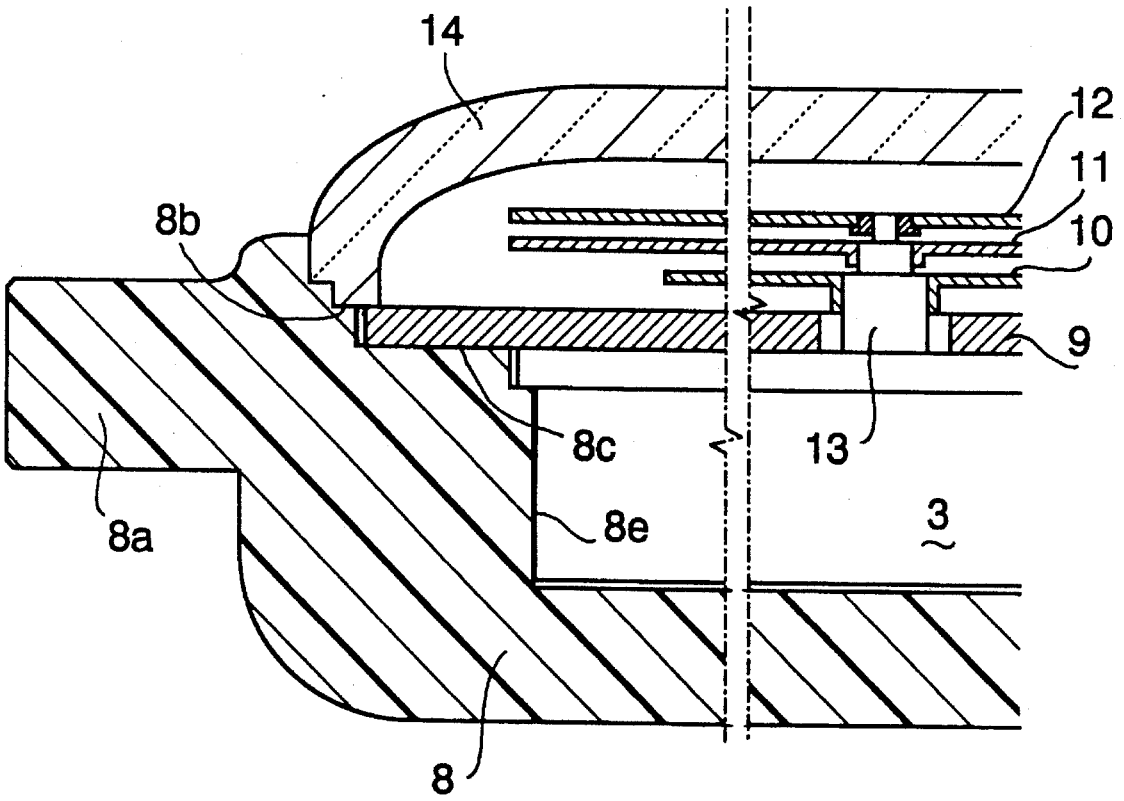
FIG. 17 PRIOR ART
FIG. 17 is a sectional view showing another conventional watch.

Referring to FIG. 1 showing an amusing watch according to the present invention, parts which are the same as the conventional watches are identified with the same reference numerals as FIGS. 16 and 17.

The watch comprises a watch case 15 has an inner recess 15*e* in which the module 3 is mounted, formed in the watch case. A dial 17 is mounted on the watch case 15 and the module 3. The dial 17 has an outer extending portion 17*a* radially and outwardly extending from the watch case 15, an upper recess 17*b*, and an underside recess 17*c* formed on the underside of the outer extending portion 17*a*. The crown 7 operatively connected to the module 3 passing through a hole 15*b* is disposed in the underside recess 17*c*, so that the crown 17 is hidden by the extending portion 17*a*. A shield 18 is mounted on the upper recess 17*b* of the dial 17 and secured thereto. A pair of band connecting portions 15*a*, one of which is not shown, are provided on the side of the watch case 15.

The watch case 15, dial 17 and shield 18 are made of ABS resin.

A battery 30*a* is mounted in a cylindrical battery chamber 21 formed in the module 3 for driving the module. A bottom 15*c* of the watch case 15 has a cylindrical opening 22 formed for communication with the chamber 21. A battery cover 31 is detachably engaged with the opening 22. A structure for holding the battery will be described hereinafter.

Figure 2:
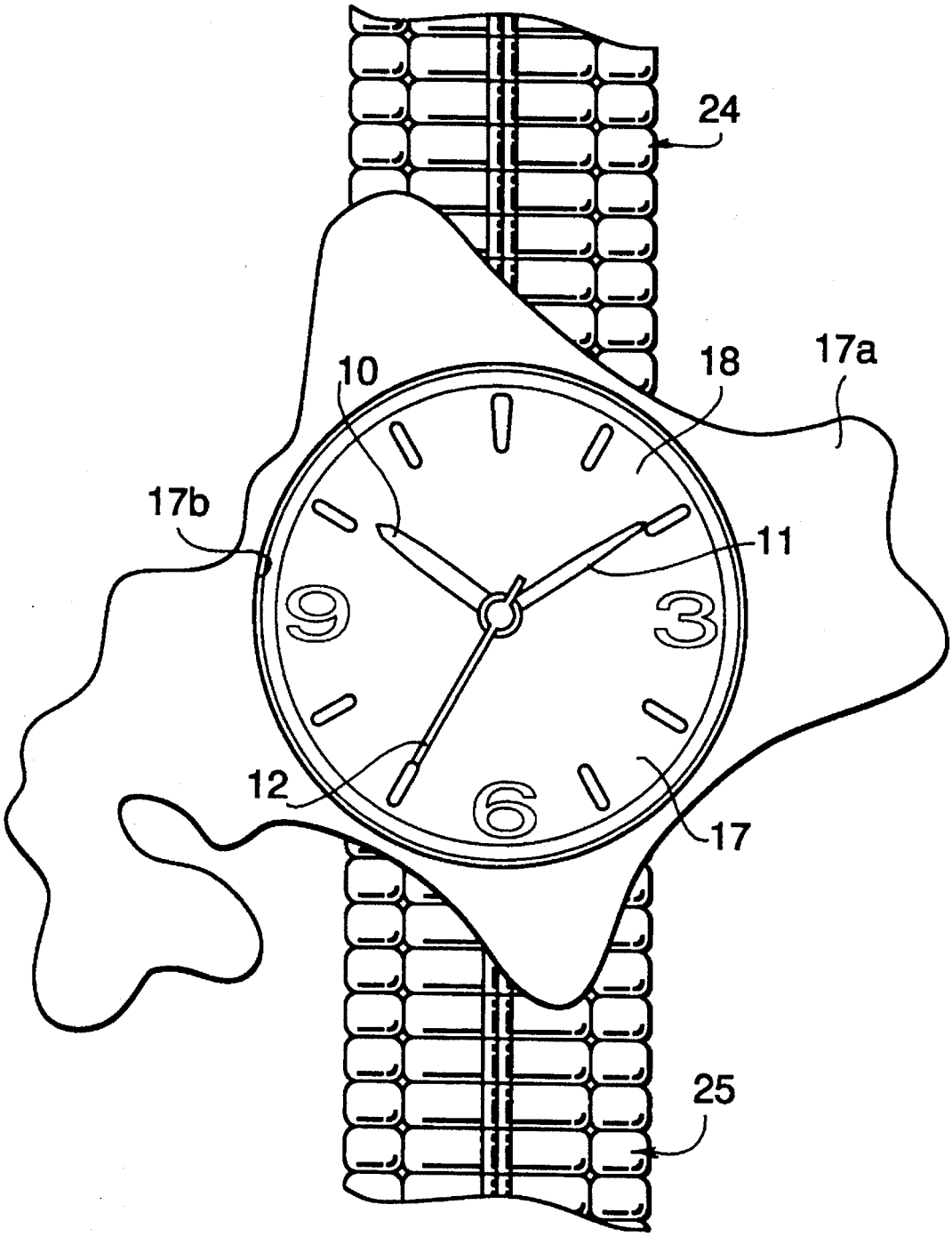
FIG. 2 is a plan view showing the watch of the present invention.
Figure 3:
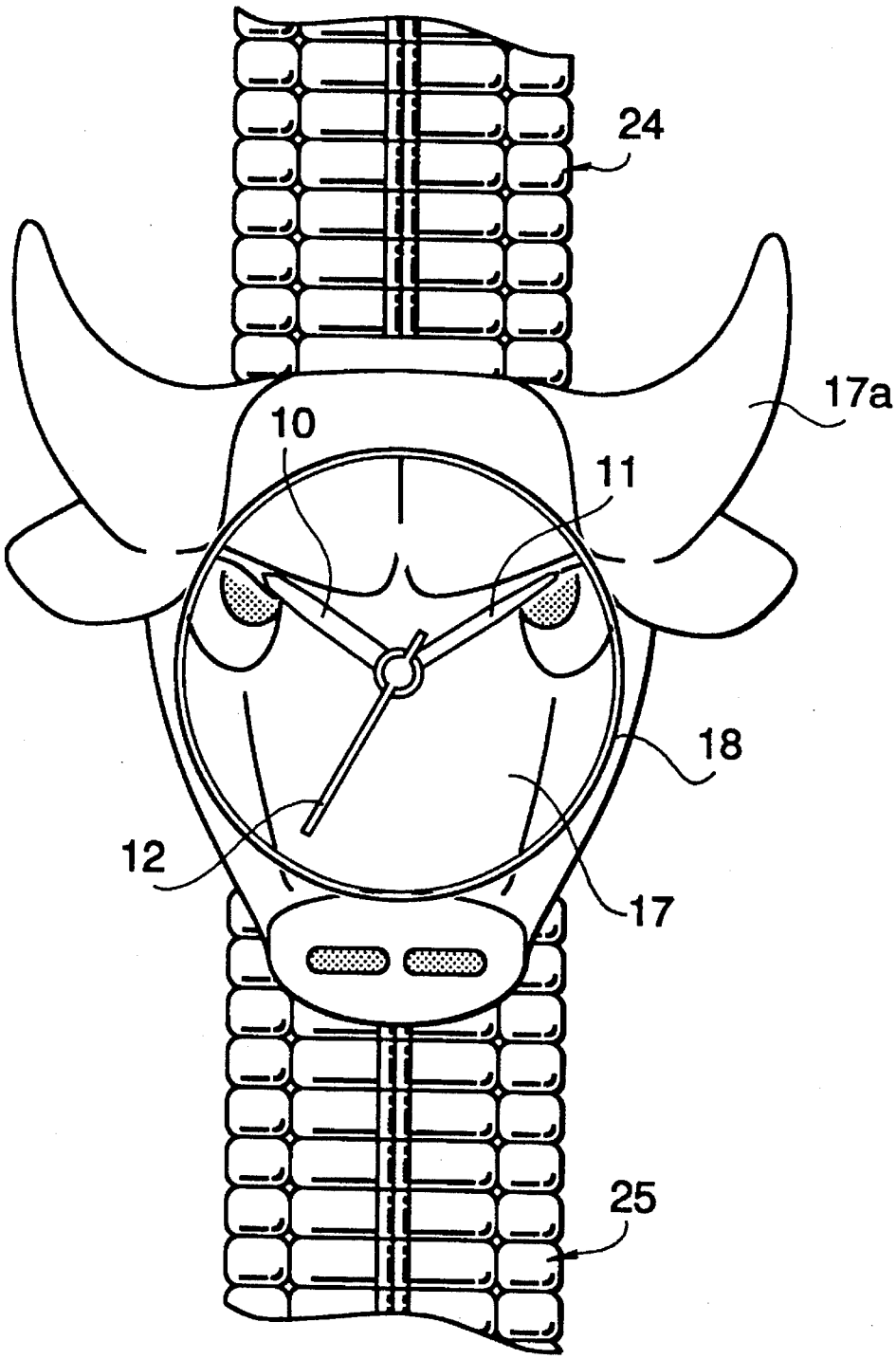
FIG. 3 is a plan view showing another design of the watch of the present invention.
Figure 4:
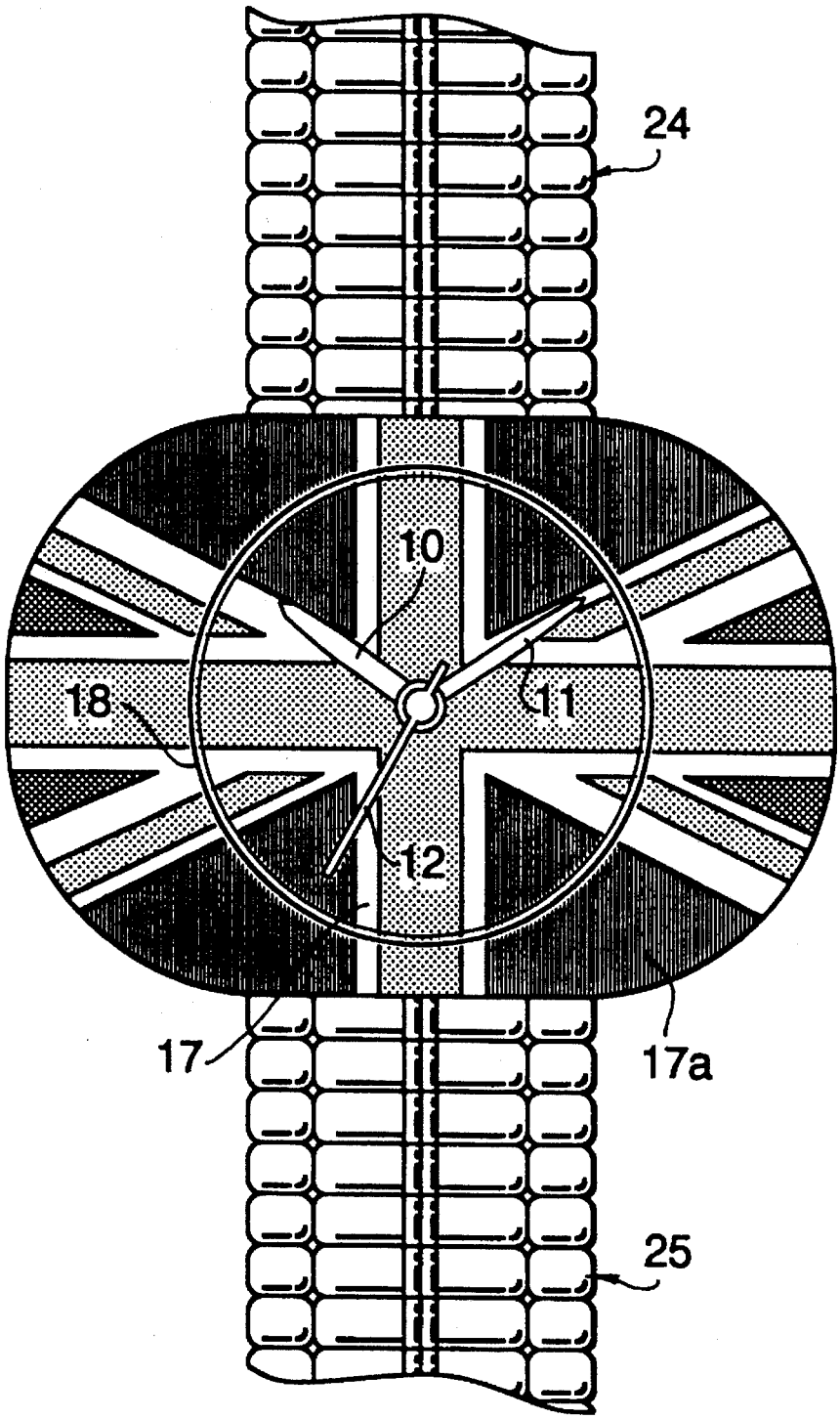
FIG. 4 is a plan view showing a further design of the watch of the present invention.

FIGS. 2 to 4 show examples of amusing watches. The dial 17 has a picture, and the outer extending portion 17*a* has a shape and a continuous pattern of the picture on the dial, thereby representing a particular meanings. The watch case (not shown) is connected to watch bands 24 and 25.

As shown in FIG. 2, the outer extending portion 17*a* has a configuration of the land of Hokkaido. The land of Hokkaido is selected as a particular shape of the land, but other various lands can be employed for the extending portion.

FIG. 3 shows the extending portion 17*a* having a configuration of a face of a bull. A part of the face is printed on the dial 17. Other animals and birds can also be printed.

FIG. 4 shows a further example representing the union Jack. Of course, other flags can be printed.

Figure 5:
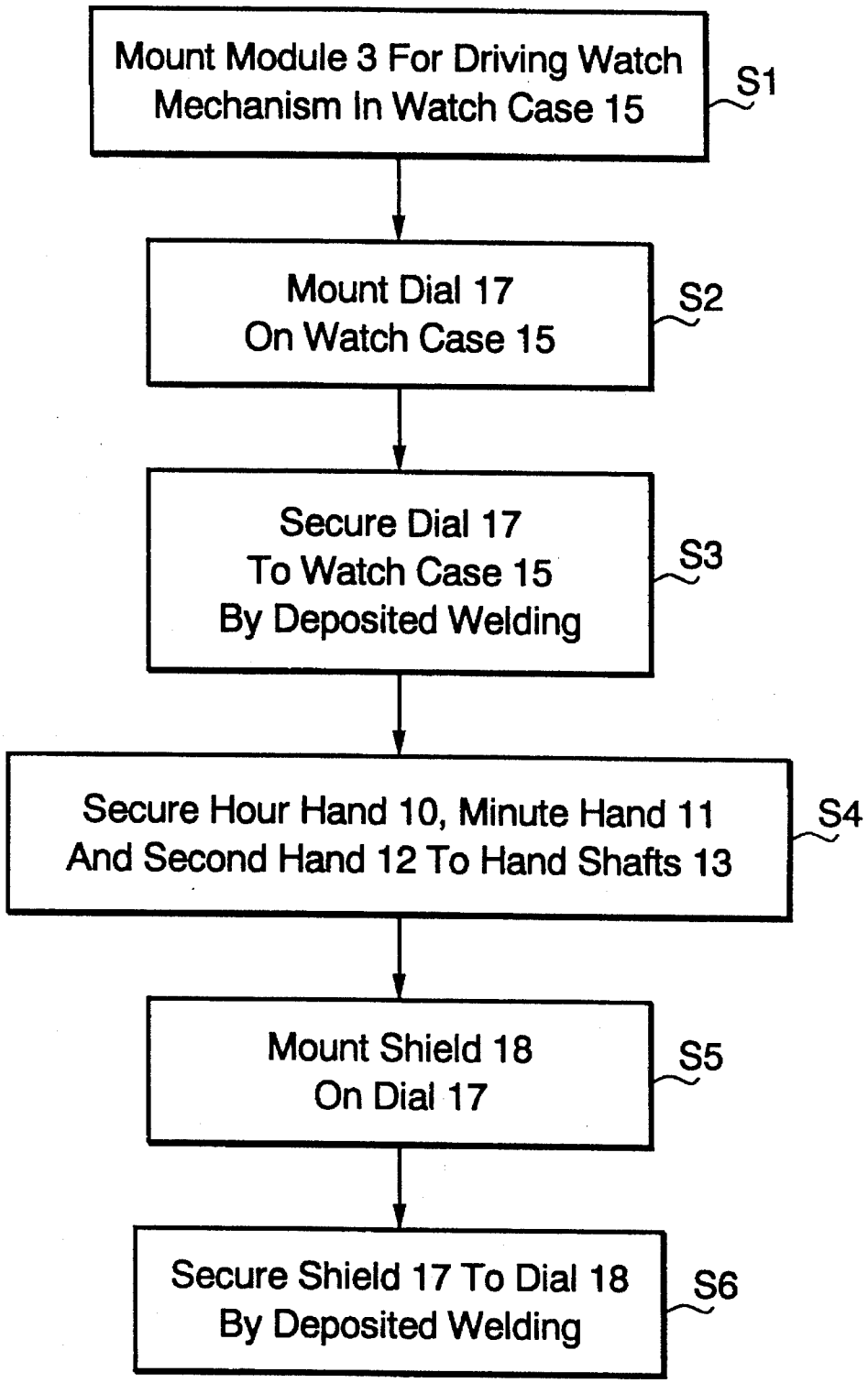
FIG. 5 is a flowchart showing a method for assembling of the watch.

The assembling of the watch will be described with reference to the flowchart of FIG. 5.

At a step S1, the module 3 is mounted in the watch case 15. At a step S2, the dial 17 is mounted on the watch case 15 and the module 3. At a step S3, the dial 17 is secured to the watch case 15 by deposited welding. At a step S4, the hands 10, 11 and 12 are secured to the hand shafts 13. At a step S5, the shield 18 is mounted on the dial 17. At a step S6, the shield is secured to the dial by deposited welding.

Figure 6:
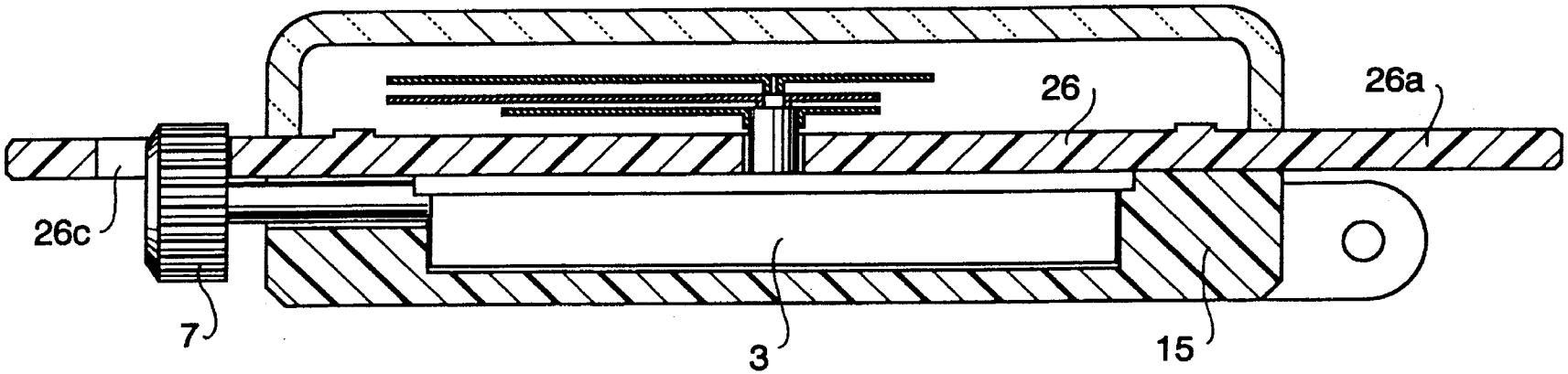
FIG. 6 is a sectional view showing a second embodiment of the present invention.

FIG. 6 shows a second embodiment where a dial 26 has an outer extending portion 26*a*, a surface of which is flush with the dial 26. A notch 26*c* is formed in the outer extending portion 26*a* corresponding to the crown 7. Thus, a part of the crown 7 is inserted in the notch 6*c*.

Other structures are the same as the first embodiment, and the same parts thereof are identified with the same reference numerals as in FIG. 1.

The watch is assembled in the same manner as in the first embodiment.

Figure 7:
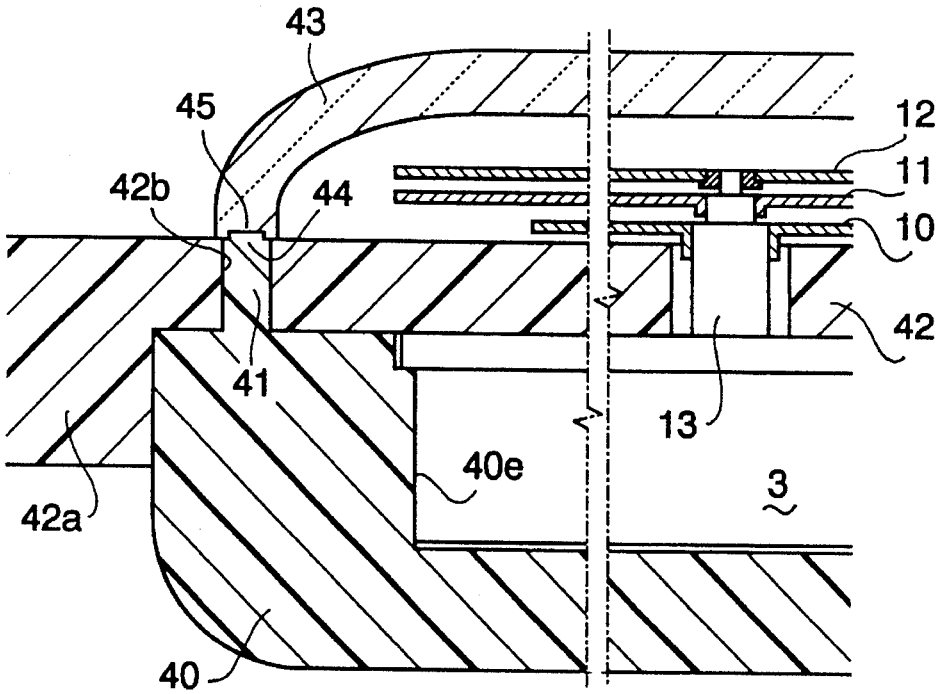
FIG. 7 is a sectional view showing a third embodiment of the present invention.

FIG. 7 shows a third embodiment of the present invention. Structures which are the same as the previous embodiments are identified with the same reference numerals as in FIG. 1.

A watch case 40 has a plurality of positioning projections 41 and a recess 40*e* for the module 3. On an upper portion of the projection 41, a melting portion 44 is provided. A dial 42 has an outer extending portion 42*a*, an upper surface of which is flush with that of the dial 42. A plurality of positioning perforations 42*b* are provided for deposited welding, corresponding to the positioning projections 41 of the watch case 40. The outer extending portion 42*a* has a thickness larger than the dial 42. A shield 43 is mounted on the dial 42 corresponding to the positioning perforations 42*b*. A groove 45 is provided on a periphery of the shield 43 corresponding to the melting portion 44 of the projection 41.

Figure 8:
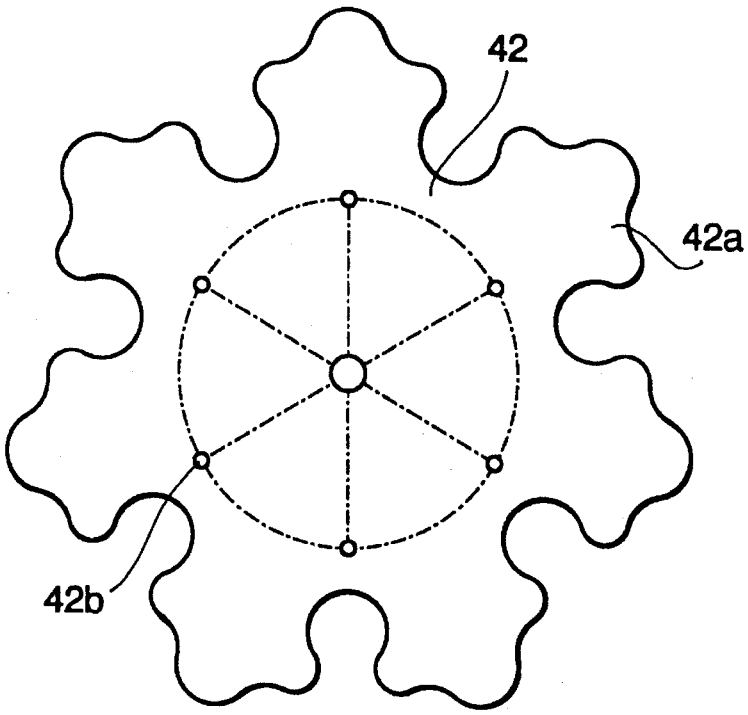
FIG. 8 is a plan view of a dial of the third embodiment.

FIG. 8 shows the dial 42. The outer extending portion 42*a* has a shape for the amusing watch. The shape is changeable to various designs to increase additional value of the watch. The positioning perforations 42*b* are provided on the circumference of the dial 42.

Figure 9:
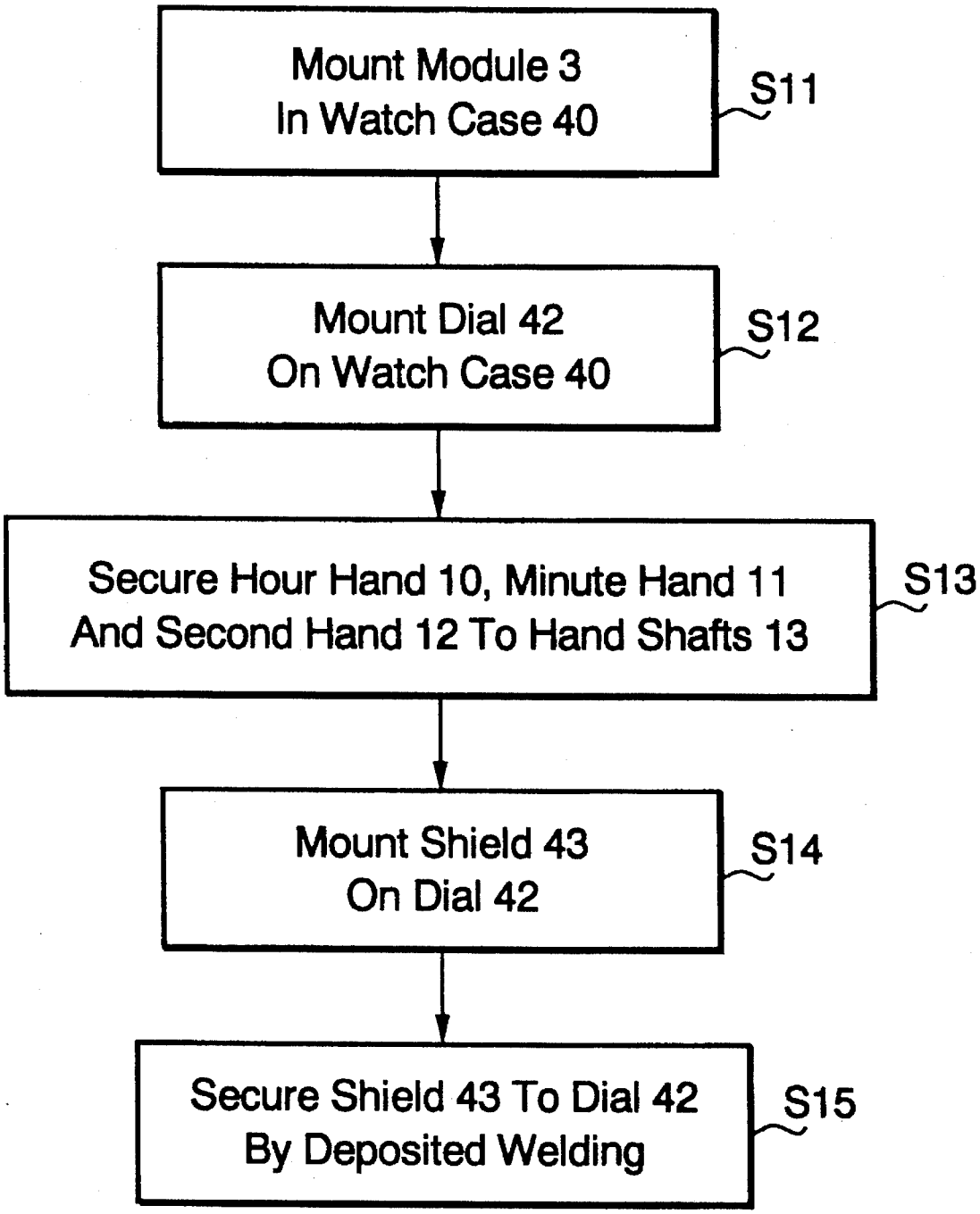
FIG. 9 is a flowchart showing a method for assembling of the watch of FIG. 7.

The assembling of the watch will be described with reference to the flowchart of FIG. 9.

At a step S11, the module 3 is mounted in the recess 40*e* of the watch case 40. At a step S12, the dial 42 is mounted on the watch case 40 and the module 3 so as to engage the positioning perforations 42*b* with the positioning projections 41. At a step S13, the hands 10, 11 and 12 are secured to the hand shafts 13. At a step S14, the shield 43 is mounted on the dial 42 corresponding to the positioning perforations 42*b*. At a step S15, the shield 43 is secured to the dial 42 by deposited welding. The melting portion 44 of the projection 41 is melted, and the groove 45 formed on the periphery of the shield 43 is filled with molten material. Thus, the watch case 40 and the shield 43 are fixed to each other.

Figure 10:
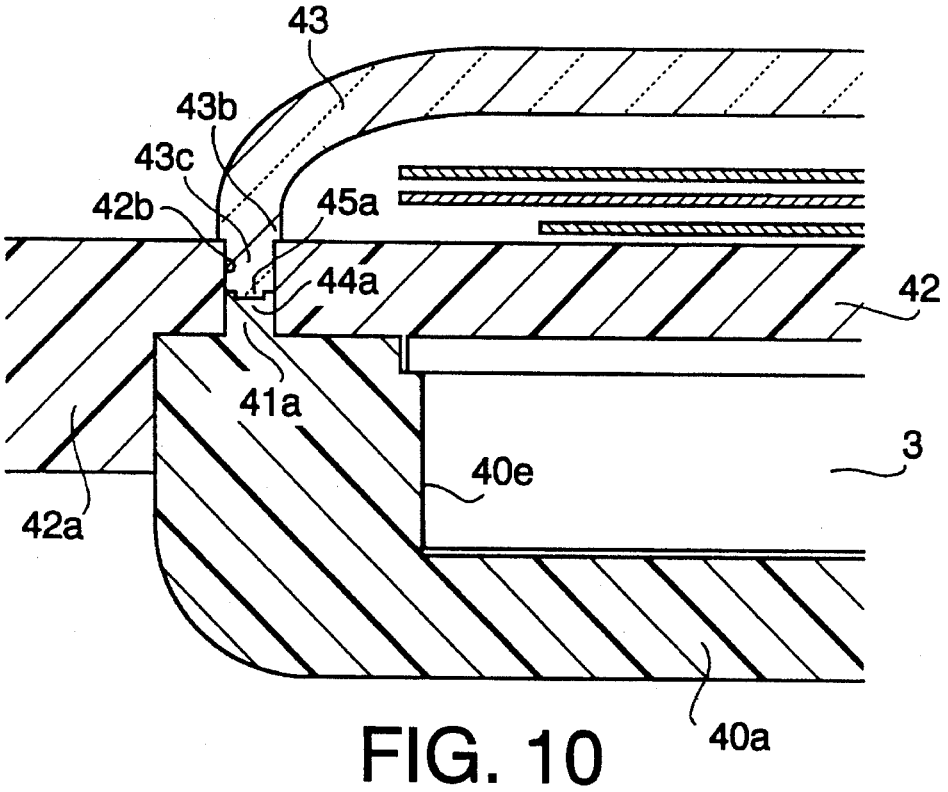
FIG. 10 is a sectional view showing a fourth embodiment.

FIG. 10 shows a fourth embodiment of the present invention. Structures which are the same as the third embodiment are identified with the same reference numerals as in FIG. 7.

A watch case 40*a* has a plurality of positioning projections 41*a* inserted in the positioning perforations 42*b* of the dial 42. The projection 41*a* has a height of half of the height of the perforation 42*b*. A groove 44*a* is formed on an upper portion of the projection 41*a*. The shield 43 has a plurality of legs 43*c* provided on the periphery corresponding to the positioning perforations 42*b*. The leg 43*c* also has a height of half of the height of the perforation, and has a melting portion 45*a* formed on an end corresponding to the groove 44*a* of the projection 41*a*. A diameter of the leg 43*c* is smaller than the thickness of the shield 43 so as to form a shoulder 43*b* at a root of the leg.

The watch is assembled in the same manner as the third embodiment. Namely, the dial 42 is mounted on the watch case 40*a* having the module 3, engaging each projection 41*a* with the corresponding perforation 42*b*. The leg 43*c* of the shield 43 is inserted into the positioning perforation 42*b* and engaged with the end of the projection 41*a*, while the shoulder 43*b* is abutted on the surface of the dial 42. By deposited welding, the melting portion 45*a* of the leg 43*c* is melted and the groove 44*a* of the projection 41*a* is filled with molten material. Thus, the watch case 40*a* is secured to the dial 43.

Figure 11:
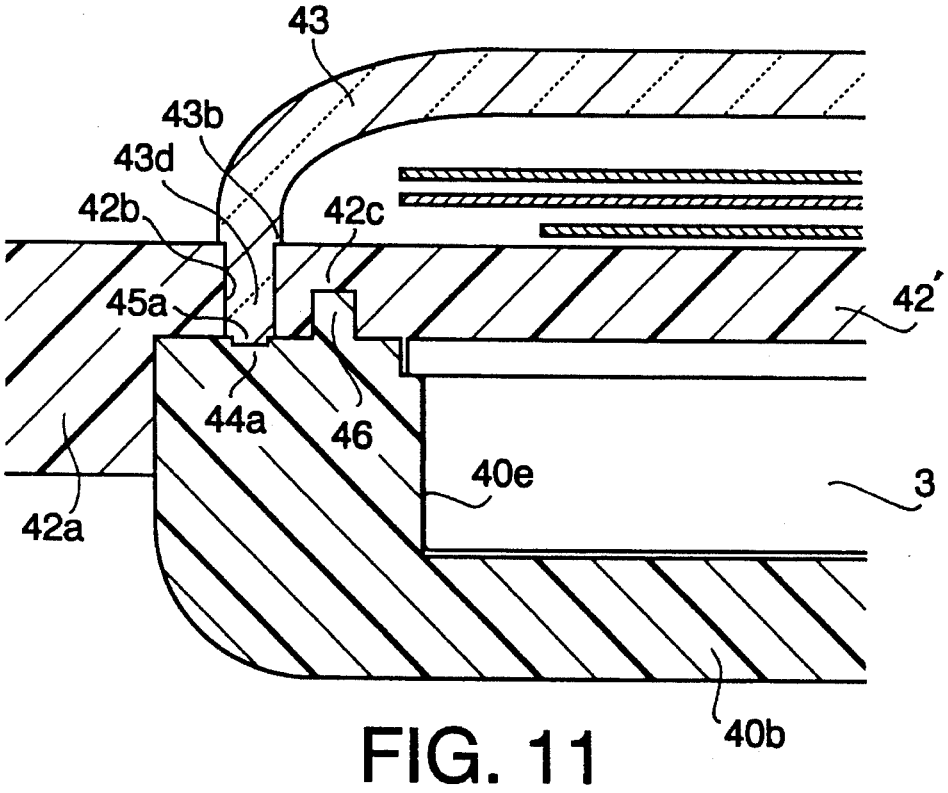
FIG. 11 is a sectional view showing a fifth, embodiment.

FIG. 11 shows a fifth embodiment of the present invention. Structures which are the same as the fourth embodiment are identified with the same reference numerals as FIG. 10.

A watch case 40*b* has a plurality of positioning projections 46. A dial 42' has a plurality of positioning holes 42*c* corresponding to the projections 46. The shield 43 has a plurality of legs 43*d*, each of which has the melting portion 45*a* inserted into the positioning perforations 42*b*, and each of which has the shoulder 43*b*. The grooves 44*a* are formed on the watch case 40*b* corresponding to the positioning perforations 42*b* of the dial 42'.

The dial 42' is mounted on the watch case 40*b* and the hole 42*c* is engaged with the projection 46. The leg 43*d* of the shield 43 is inserted into the perforation 42*b* and engaged with the groove 44*a* of the watch case, while the shoulder 43*b* is abutted on the surface of the dial 42'. By deposited welding, the groove 44*a* of the watch case 40*b* is filled with the molten material of the leg 43*d* of the shield 43, thereby fixing the watch case to the shield.

In the latter embodiment, it is not necessary to engage the positioning perforation 42*b* with the leg 43*d* with accuracy, since the dial 42' is positioned by the projection 46.

The battery holding structure provided in the watch will now be described. Two types of battery holding structure are known. One of the structures is such that the battery is held by a back of the watch case, and the other is such that the battery is held by a watch cover detachably mounted on the watch case. The latter structure is advantageous in that the inside space of the watch case can be perfectly shielded.

Figure 18:
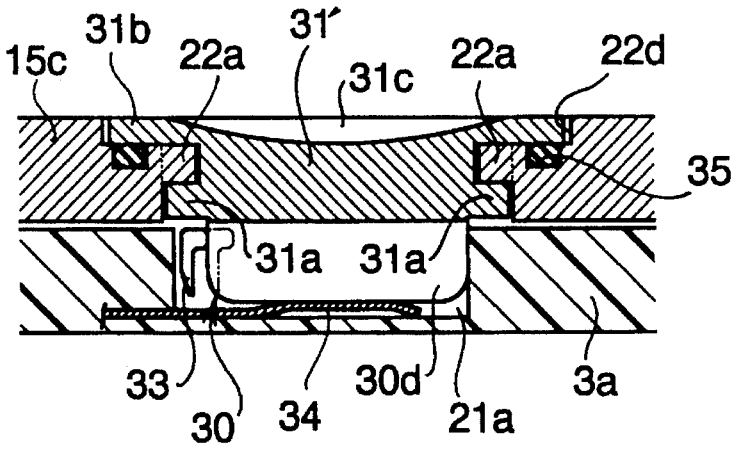
FIG. 18 PRIOR ART
FIG. 18 is a sectional view showing a conventional battery holding structure.
Figure 19:
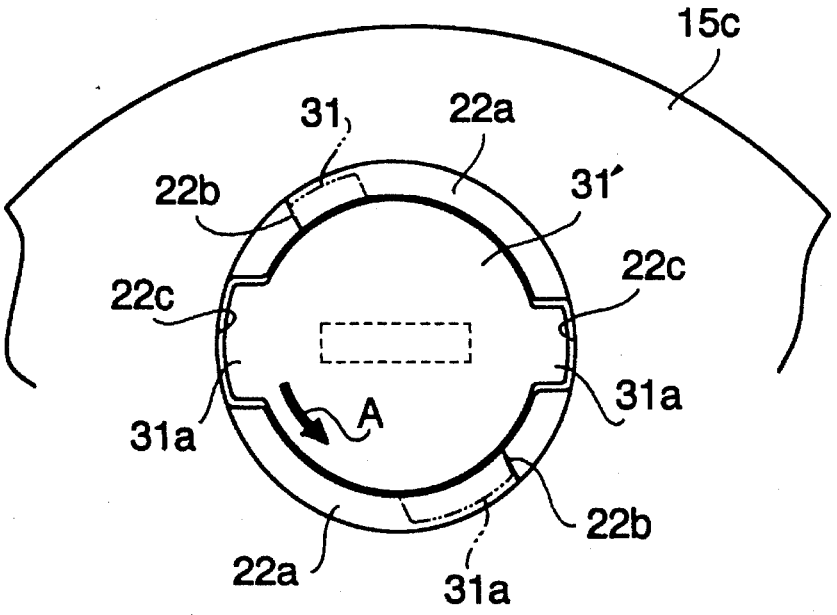
FIG. 19 PRIOR ART
FIG. 19 is a plan view showing a conventional battery holding structure of FIG. 18.

FIGS. 18 and 19 show a conventional battery holding structure of the battery cover holding type. An opening 22*d* formed in the bottom 15*c* of the watch case 15 has radially inwardly extending flanges 22*a* provided on a middle portion of the opening, and a pair of notches 22*c* formed between the flanges 22*a* opposite to each other. One of the notches 22*c* is larger than the other in circumferential direction as shown in FIG. 19. A stopper 22*b* is formed in the space below the inner projection 22*a* at the opposite end to the notch 22*c*.

A battery cover 31' is attached to the bottom 15*c* of the watch case by the bayonet coupling. Namely, the battery cover 31' has a cover portion 31*b* engaged with upper sides of the flanges 22*a* interposing an annular packing 35, and a pair of outwardly projecting lugs 31*a* formed on a lower portion of the cover 31' corresponding to the notches 22*c* of the opening 22*d*. Therefore, one of the outer lugs 31*a* is formed larger than the other. A groove 31*c* is formed on the surface of the cover portion 31*b*. A tool is engaged with the groove 31*c* for rotating the cover 31'.

In a battery chamber 21*a* of a module 3*a*, a side spring 33 is provided on an inner periphery of the camber 21*a*, and is connected to a plus terminal of a circuit board (not shown) of the module. A base spring 34 is provided on a bottom of the chamber, and connected to a minus terminal of the circuit board. When the battery 30 is inserted into the chamber 21*a*, the side spring 33 is connected to a positive electrode can 30*d* of the battery, and the base spring 34 is connected to a negative electrode can of the battery.

The battery 30 is inserted in the chamber 21*a* passing through the opening 22*d* and engaged with the springs 33 and 34, respectively. The positive electrode can 30*d* pushes the side spring 33 from the dot-dash line position to the solid line position in FIG. 18. The cover 31' is inserted into the opening 22*d* to mount the cover portion 31*b* on the inner projection 22*a*, while the outer lugs 31*a* are engaged with the respective notches 22*c*. Then, the cover 31' is rotated in a direction shown by an arrow A by the tool engaged with the groove 31*c* so that each lug 31*a* of the cover is inserted in a space below the inner projection 22*a* and engaged with the underside of the projection. A base portion of the cover 31' pushes the battery 30, so that the positive electrode can 30*d* of the battery is engaged with the side spring 33 and the negative electrode can is engaged with the base spring 34.

In such a structure, since the side spring 33 is engaged with the battery 30 at the side wall thereof as shown in FIG. 18, it is difficult to remove the battery from the chamber 21*a*. Furthermore, a battery having a diameter decided by the size of the module 3*a* must be used. In other words, a battery having a diameter which does not conform with the size of the module 3*a* cannot be used, although the characteristic and capacity of the battery meet the requirement of the module. Such a commercial condition is very inconvenient for the user in changing of the battery.

Consequently, the battery holding structure of the present invention is capable of changing batteries having various sizes, as described hereinafter.

Figure 12A:
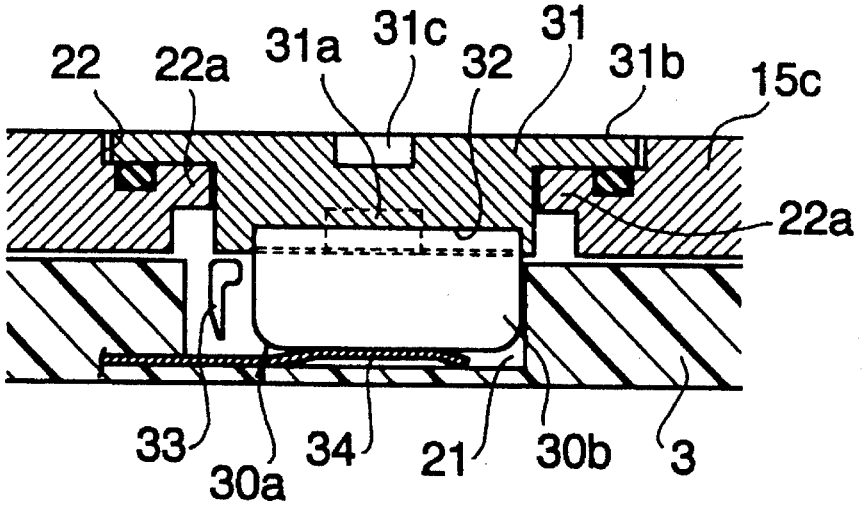
FIGS. 12*a* and 12*b* are sectional views showing a battery holding structure in the watch.
Figure 12B:
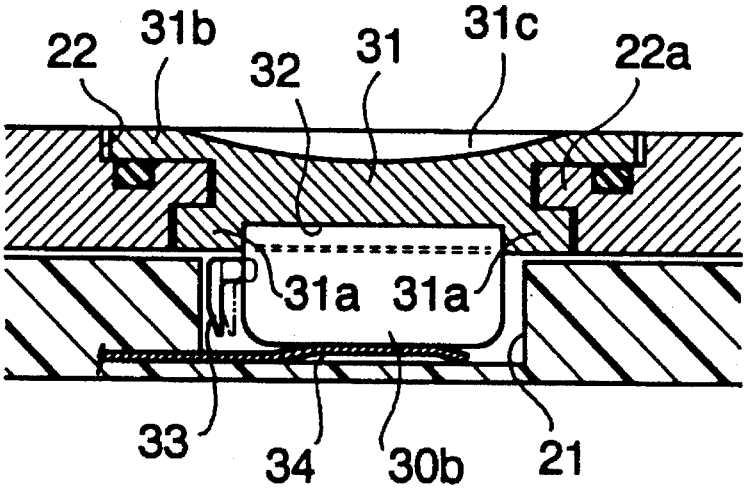
Figure 13A:
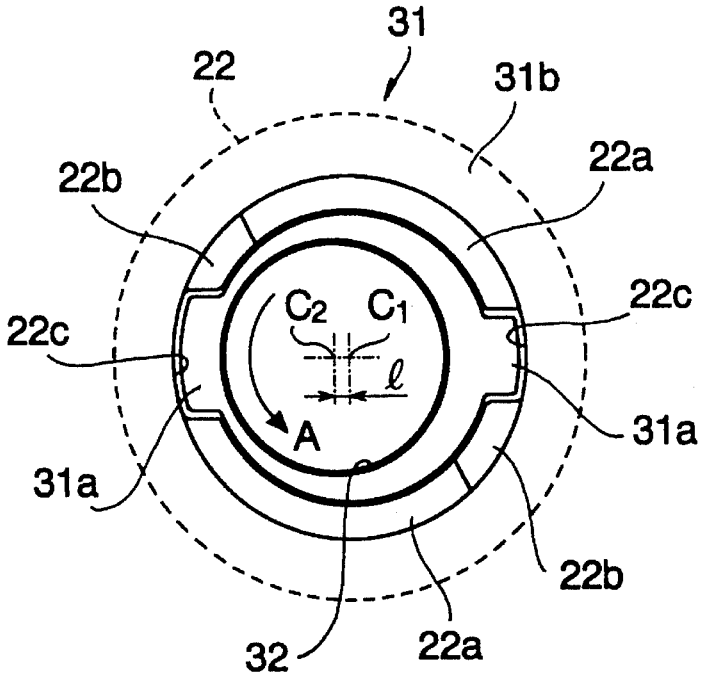
FIGS. 13*a* and 13*b* are plan views showing the battery holding structure.

Referring to FIGS. 12*a*, 12*b*, 13*a* and 13*b* showing the battery holding structure of the present invention, the bottom 15*c* of the watch case 15 has the circular opening 22 and the cover 31 has a circular recess 32 formed on the underside thereof. The recess 32 has a diameter for the battery 30*a* which has a small diameter as described above. As shown in FIG. 13*a*, the recess 32 is eccentrically formed on the underside of the cover 31. Namely, a center C2 of the recess 32 is deflected from a center C1 of the rotation of the cover 31 by a distance l. The direction of the eccentricity is determined by the positional relationship between the stopper 22*b* and the side spring 33.

Other structures are the same as the conventional structures and the same parts thereof are identified with the same reference numerals as in FIGS. 18 and 19.

The positive electrode can 30*b* of the battery 30*a* is mounted in the recess 32 of the cover 31. The outer lugs 31*a* of the cover 31 are positioned to the notches 22*c* so that the battery 30*a* is inserted into the chamber 21. In this state, the positive electrode can 30*b* of the battery 30*a* does not contact with the side spring 33 as shown in FIG. 12*a*.

When the cover 31 is rotated, the outer lugs 31*a* are slidably slid on the undersides of the inner projections 22*a* and the battery 30*a* is rotated about the center C1 of the cover. When the outer lugs 31*a* are engaged with the stoppers 22*b*, the cover 31 stops rotating. In this state, the positive electrode can 30*b* contacts the side spring 33 to urge the spring outwardly in a position as shown in FIG. 13*b* so that the side spring 33 is pressed against the positive electrode can 30*b*.

Figure 13B:
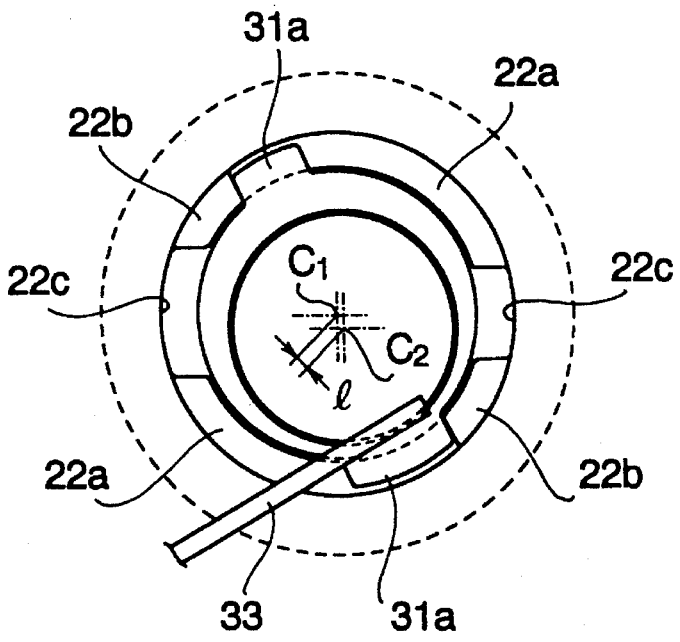

As shown in FIG. 13*b*, in order to obtain a sufficient side pressure of the side spring 33, the eccentric center C2 of the recess 32 is positioned on a line connecting the center C1 of the cover 31 and the lug 31*a* stopped by the stopper 22*b*. Since the battery 30*a* is mounted in the recess 32 of the cover 31, the positioning of the battery is exactly determined.

Figure 14:
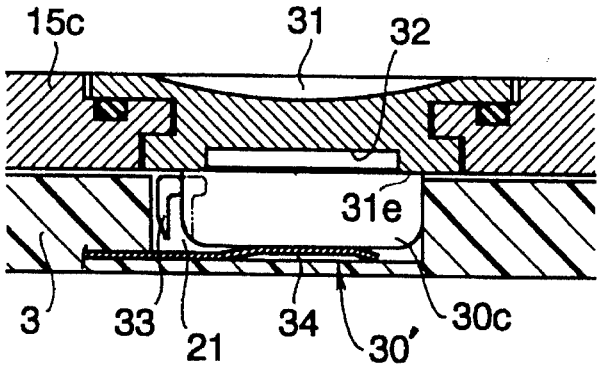
FIG. 14 is a sectional view showing a modification of the battery holding structure.

FIG. 14 shows a modification of the battery holding structure. If a battery 30' has a larger diameter than the battery 30*a*, the battery 30' cannot be mounted in the recess 32. Therefore, the battery 30' is directly mounted in the chamber 21 and depressed by the peripheral land 31*e* of the cover 31 to the base spring 34. Since the battery has a large diameter, the positive electrode can 30*c* is contacted with the side spring 33.

Figure 15A:
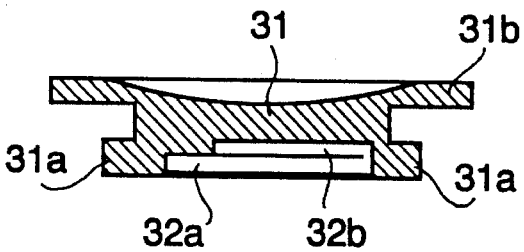
FIGS. 15*a* and 15*b* are schematic diagrams showing another modification of the battery holding structure.
Figure 15B:
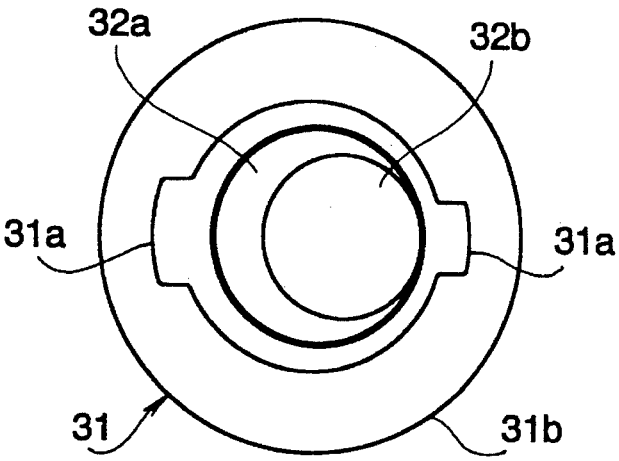

FIGS. 15*a* and 15*b* show another modification where the cover 31 has a large recess 32*a* and a small eccentric recess 32*b* communicated with the recess 32*a*. Consequently, in the modification, two types of batteries which are different in diameter can be used. A battery having a larger diameter than the two types of batteries is mounted in the chamber 21 in the same manner as in FIG. 14.

A plurality of recesses more than two can be formed in the cover.

Thus, in the structure of the present invention, several sizes of batteries can be used.

In accordance with the present invention, the dial has the outwardly extending portion formed integral therewith. Since, the dial is integral with the outer extending portion, the number of parts is reduced so that the manufacturing cost is reduced.

Furthermore, since the dial and the extending portion are integral with each other, it is possible to provide a continuous picture on the dial and the extending portion. By changing only the dial, the design of the watch can be changed without changing the watch case. Therefore, design variations of the watch are easily increased.

If the surface of the dial is flush with the surface of the outer extending portion, the boundary between the dial and the outer extending portion disappears. Consequently, the picture having a completely continuous pattern can be printed on the entire surfaces of the dial and the outer extending portion, thereby increasing quality of commercialized products and the appearance of the amusing watch. In addition, the watch case is easily welded by welding with a low cost.

While the invention has been described in conjunction with preferred specific embodiment thereof, it will be understood that this description is intended to illustrate and not limit the scope of the invention, which is defined by the following claims.

What is claimed is:

1. A structure of a watch comprising a watch case having a pair of band connecting portions and a crown, a module mounted in the watch case, a dial secured to the watch case, hands disposed above the dial and operatively connected to the module, and a shield for shielding the dial;

the structure further comprising an extending portion extending outwardly and horizontally from the dial and projected from peripheries of the watch case and the shield;

the dial being secured to the watch case and the shield being secured to the dial;

said band connecting portions being concealed by the extending portion of the dial and said crown being at least partially concealed by said extending portion of the dial and said crown being at least partially concealed by said extending portion of the dail.

2. The structure according to claim 1 wherein the extending portion has a peripheral shape representing a concrete meaning.

3. The structure according to claim 1 wherein a continuous picture is depicted on the dial and the extending portion.

4. The structure according to claim 1 wherein the extending portion is flush with the dial.

5. The structure according to claim 1 further comprising positioning means for positioning the shield at a proper position on the dial.

6. The structure according to claim 5 wherein the positioning means comprises a plurality of perforations formed in the dial, the watch case has projections inserted in the perforations, and the shield is secured to a top of each of the projections.

7. The structure according to claim 5 wherein the positioning means comprises a plurality of perforations formed in the dial, the shield has projections inserted in the perforations, and the shield is secured to the watch case at a top of each of the projections.

8. The structure according to claim 1 wherein the extending portion covers crown of the watch.

9. The structure according to claim 8 wherein an extending portion has a recess at the underside thereof for receiving a part of the crown.

10. The structure according to claim 8 wherein the extending portion has a notch in which a part of the crown is inserted.

11. The structure according to claim 1 wherein the watch case, the dial, and the shield are made of plastic.

12. The structure according to claim 11 wherein the watch case, the dial, and the shield are welded with each other, thereby watertightly sealing the spaces between the watch case and the dial and the space between the dial and the shield.

13. The structure according to claim 1, wherein a bottom of the watch case has a circular opening communicating with a battery chamber formed in the module, a battery cover has a circular recess in an underside thereof so as to hold a battery and is attached to the bottom at the circular opening by a bayonet coupling, a center of the circular recess being positioned at a location displaced from a center of rotation of the battery cover caused by structure of the bayonet coupling, so that an outer can of the battery engages with a side spring provided on an inner wall of the circular opening at a stopped position of the bayonet coupling.

14. A structure of a watch comprising a watch case having a pair of band connecting portions and a crown, a module mounted in the watch case, a dial secured to the watch case, hands disposed above the dial and operatively connected to the module, and a shield for shielding the dial;

the structure further comprising an extending portion extending outwardly from the dial and protected from peripheries of the watch case and the shield;

the dial being secured to the watch case and the shield being secured to the dial;

said band connecting portions being concealed by the extending portion of the dial and said crown being at least partially concealed by said extending portion of the dial;

wherein a bottom of the watch case has a circular opening communicating with a battery chamber formed in the module, a battery cover has a circular recess in an underside thereof so as to hold a battery and is attached to the bottom at the circular opening by a bayonet coupling, a center of the circular recess being positioned at a location displaced from a center of rotation of the battery cover caused by structure of the bayonet coupling, so that an outer can of the battery engages with a side spring provided on an inner wall of the circular opening at a stopped position of the bayonet coupling.

* * * * *